United States Patent [19]

Petrus

[11] Patent Number: 4,813,308

[45] Date of Patent: Mar. 21, 1989

[54] TOOL ADAPTER AND METHOD OF USING SAME

[76] Inventor: David Petrus, 24900 S. Western Ave., Park Forest, Ill. 60466

[21] Appl. No.: 123,197

[22] Filed: Nov. 20, 1987

[51] Int. Cl.[4] ..... B25B 17/00

[52] U.S. Cl. ..... 81/57.29

[58] Field of Search ..... 81/57.29, 57.13, 57, 81/57.22, 57.32

[56] References Cited

U.S. PATENT DOCUMENTS

| | | | |
|---|---|---|---|
| 1,299,591 | 4/1919 | Malchow | 81/57.29 |
| 1,645,570 | 6/1924 | Anderson | 81/57.29 |
| 2,594,669 | 4/1952 | Marshall | 81/57.29 |
| 4,453,433 | 6/1984 | Clement | 81/57.29 |
| 4,455,896 | 6/1984 | Holmes | 81/57.29 |
| 4,474,089 | 10/1984 | Scott | 81/57.29 |
| 4,524,649 | 6/1985 | Diaz | 81/57.13 |

*Primary Examiner*—James G. Smith

[57] ABSTRACT

A tool adapter for loosening, tightening or freeing a locked nut or bolt, includes a housing, a top gear, and a pair of oppositely disposed spaced-apart side gears, which are secured rotatably to the housing. A locking mechanism causes the top gear and the side gears to become interlocked in a stationary position with the housing. A spacer is disposed inside the housing, for retaining rotatably the top gear and the side gears in position inside the housing.

14 Claims, 1 Drawing Sheet

25
27

34
81
41
11
43
44
75
23
20
2
3
77
75
2
3
40
42
20
98
12
34
93
41
100
118
117
87
85
95
140
16
14
80
120
125
127
154
31
108
80
11
77
105
18
107
122
150
90
140
152
33

12 causes the side gears axles 14 and 16 to be rotated in opposite directions relative to one another. Hence, if it is desired to tighten the nut or bolt, a corresponding one of the side gears, such as the side gear 14 is used. On the other hand, if it is desired to loosen the nut or bolt, the other side gear 16 is used instead.

When it is desired to free a locked nut or bolt, the top gear 12 is rotated in a counter-clockwise direction in order to become interlocked to the housing 11, by the locking mechanism 34. The locking of the top gear 12 causes the side gears 14 and 15 to be concurrently locked in position, so as to give the tool adaptor 10 a solid, unitary construction, similar to that of an angle head. Therefore, the tool adaptor 10 can now be used for freeing locked nuts or bolts, without the substantial risk of breaking or rupturing the teeth of the gears 12, 14 or 16.

Considering now the housing 11 in greater detail with respect to FIGS. 1, 2 and 3, it generally includes an elongated tubular member 75, that is hollow throughout substantially its entire axial length. The member 75 has a metallic composition, and a circular cross section. The member 75 is partially closed at one end thereof by a flat side plate 77. The side plate 77 is generally circular, and has a central opening 80, that is sized and dimensioned to receive the side axle 31 of the side gear 14. While the side plate 77 is shown and described as depending integrally from the member 75, it should be understood that the side plate 77 can be secured detachably to the member 75, by known techniques, such as by means of a snap ring.

Another flat side plate 85 is spaced apart from the side plate 77, and it is disposed in a substantially parallel position relative thereto. The side plate 85 is retained inside, and is secured to, the hollow tubular member 75 by means of a snap ring 87. The side plate 85 includes a central opening 90, that is oppositely disposed and substantially aligned with the central opening 80 of the opposite side plate 77. The opening 90 is designed and dimensioned to receive the side axle 33 of the side gear 16.

The housing 11 further includes a raised top portion 41 that is substantially circular in cross-section, and that defines a central opening 42, for receiving the drive axle 20 of the top gear 12. The opening 42 is disposed in a plane that is substantially perpendicular to the side plates 77 and 85, for enabling the top gear 12 to be meshed simultaneously with the side gears 14 and 16.

Considering now the top gear 12 in greater detail with respect to FIGS. 2 and 3, it generally includes a bevel pinion gear 93 that tapers conically inwardly toward its central axis. A relatively long cylindrical stud shaft 95 extends inwardly from the gear 93, engages rotatably the spacer 18. A generally circular collar 98 is secured fixedly to the outer side of the gear 93, and faces the inner wall of the top portion 41 of the housing 11.

An elongated tubular drive axle 20 extends outwardly dorsally from the outer side of the collar 98, of the top gear 12 at a substantially right angle thereto. The drive axle 20 is generally hollow throughout its entire axial length, so as to engage other tools, such as the extension 23 or the T-handle 25.

The locking mechanism 34 generally causes the top gear 12 to engage the top portion 41 threadably. In this regard, the axle 20 includes at least one thread, such as the thread 44 for engaging corresponding complementary sized threaded holes, such as the hole, 43. The threaded hole 43 is disposed on the housing 11 and extending axially about the outer periphery of the drive axle 20, adjacent the collar 98.

Thus, when it is desired to lock the drive axle 20 to the housing 11, the top gear 12 is rotated in a counter-clockwise direction, so as to cause the thread 44 to mesh with the complementary hole 43. The collar 98 is thereby forced against the inner wall of the top portion 41, and the top gear 12 engages lockingly the housing 11 as well as the side gears 14 and 16.

When the top gear 12 is in an unlocked position relative to the housing 11, a clearance space 100 is defined between the collar 98 and the inner wall of the raised top portion 41. The clearance space 100 is particularly designed and dimensioned so as to cause the top gear 12 to remain meshed with the side gears 14 and 16, when it is locked therewith and with the housing 11. In this regard, when the drive axle 20 is locked threadably with the top portion 41, the top gear is caused to move outwardly away from the side gears 14 and 16. Thus, the pinion gear 93 tends to disengage from the side gears 14 and 16.

For the purpose of dimensioning the clearance space 100, the depth and degree of inclination of meshing teeth of the pinion gear 93 and the side gears 14 and 16 are designed in such a way as to cause the pinion gear 93 to remain meshed with the side gears 14 and 16, when the top gear 12 engages threadably the top portion 41.

While one locking mechanism 34 has been described, it will become apparent to those skilled in the art that other locking devices may be used.

Considering now the side gear 14, it generally includes a bevel pinion gear 105, that tapers conically, inwardly toward its central axis. The pinion gear 105 meshes with the bevel pinion gear 93, and is driven thereby, when the top gear 12 is rotated axially. A relatively short cylindrical stud shaft 107 extends inwardly from the gear 105 for engaging rotatably the spacer 18. A generally circular collar 108 is secured fixedly to the outer side of the gear 105 and faces the inner wall of the side plate 77. The outer side of the collar 108 is lubricated so as to minimize the frictional resistance with the housing 11, when the side gear 14 is rotated axially. In order to enhance the axial rotatability of the side gear 14, a clearance space 117 is defined between the outer side of the collar 108 and the side plate 77.

A circular disc 118 is secured to the outer side of the collar 108, and extends through the central opening 80, in order to cause the side gear 14 to be retained in position by the side plate 77. The disc 118 is complementary sized and dimensioned relative to the opening 80, so as to enable the side gear 14 to rotate freely, while still being retained by the side plate 77.

An elongated side axle 31 is secured fixedly to the outer side of the disc 118, and it extends a short distance beyond the side plate 77. The side axle 31 has a generally square cross-section, so as to enable its engagement with other tools, such as a socket extender 40 (FIG. 1). A stud 120 extends radially outwardly from the side axle 31, in order to enhance its engagement with the socket extender 40.

The side gear 16 is substantially similar to the side gear 14, and it is spaced therefrom by the spacer 18. The side gear 16 generally includes a relatively short stud shaft 140 that is similar to the short stud shaft 107. The side gear 16 also includes a bevel pinion gear 150, a collar 152, and a disc 154 that are substantially similar in design and dimension to the gear 105, collar 108, and

TOOL ADAPTER AND METHOD OF USING SAME

TECHNICAL FIELD

The present invention relates in general to a tool adaptor, and it relates more particularly to a tool adaptor which is positionable in restricted or confined places, and method of using it, for loosening, tightening or freeing a bolt, nut or such other similar devices.

BACKGROUND ART

Tool constructions of the general type with which the present invention is concerned, are widely employed for various applications. For instance, the U.S. Pat. Nos. 2,206,802, 2,594,669, 2,701,490, 4,215,599, and 4,299,145, generally relate to wrench constructions which are operated by lateral swinging movements of the wrench handle.

However, the handle oscillatory movements require a substantial space for imparting the necessary torque to the nut or bolt to be loosened, tightened or freed. Certain circumstances do not permit the use of such wide handle movements. For instance, when the nut or bolt is positioned in a confined or restricted place, such as inside a hollow elongated cylinder, the wrench handle may not be oscillated to impart the necessary torque, due to the lack of space.

There have been several attempts to rectify the foregoing concern associated with the application of a wrench to a nut or to the head of a bolt in a confined space. For instance, the U.S. Pat. Nos. 2,716,363, 4,240,310, and 4,299,145 generally relate to wrenches in which a socket member is driven rotatably rather than in an oscillatory motion.

Such conventional tools are not usable conveniently for loosening or tightening nuts or bolts, as well as for freeing any such locked nuts or bolts. In this regard, the rotary movement of the socket member is frequently conveyed by means of meshing gears. However, the gears do not generally withstand excessive forces or torques, such as those required to free a locked nut or bolt. Thus, when extreme torques are applied, the teeth of the meshing gears can fracture or break, and the entire tool would have to be discarded.

Therefore, it would be highly desirable to have a new and improved tool adaptor that is positionable in restricted or confined places for loosening or tightening nuts or bolts, as well as for freeing locked nuts or bolts. The tool adaptor should be designed for universal use in conjunction with T-handles, ratchets, wrenches, extensions, sockets, socket extenders, and like tools.

DISCLOSURE OF INVENTION

Therefore, it is an object of the present invention to provide a new and improved tool adaptor that is positionable in restricted or confined places, and a method of using it for loosening or tightening nuts or bolts.

It is another object of the present invention to provide a new and improved tool adaptor and method of using it for freeing locked nuts or bolts in restricted or confined places.

Briefly, the above and further objects and features of the present invention are realized by providing a new and improved tool adaptor that is positionable in restricted or confined places for loosening, tightening, or freeing locked nuts or bolts.

The tool adaptor comprises a housing, a top gear, and a pair of oppositely disposed spaced-apart side gears, which are secured rotatably to the housing. A locking mechanism causes the top gear and the side gears to become interlocked in a stationary position with the housing. A spacer is disposed inside the housing, for retaining rotatably the top gear and the side gears in position inside the housing.

BRIEF DESCRIPTION OF DRAWINGS

The above mentioned and other objects and features of this invention and the manner of attaining them will become apparent, and the invention itself will be best understood by reference to the following description of the embodiment of invention in conjunction with the accompanying drawings, wherein.

BEST MODE FOR CARRYING OUT THE INVENTION

Figures 1, 2, 3:
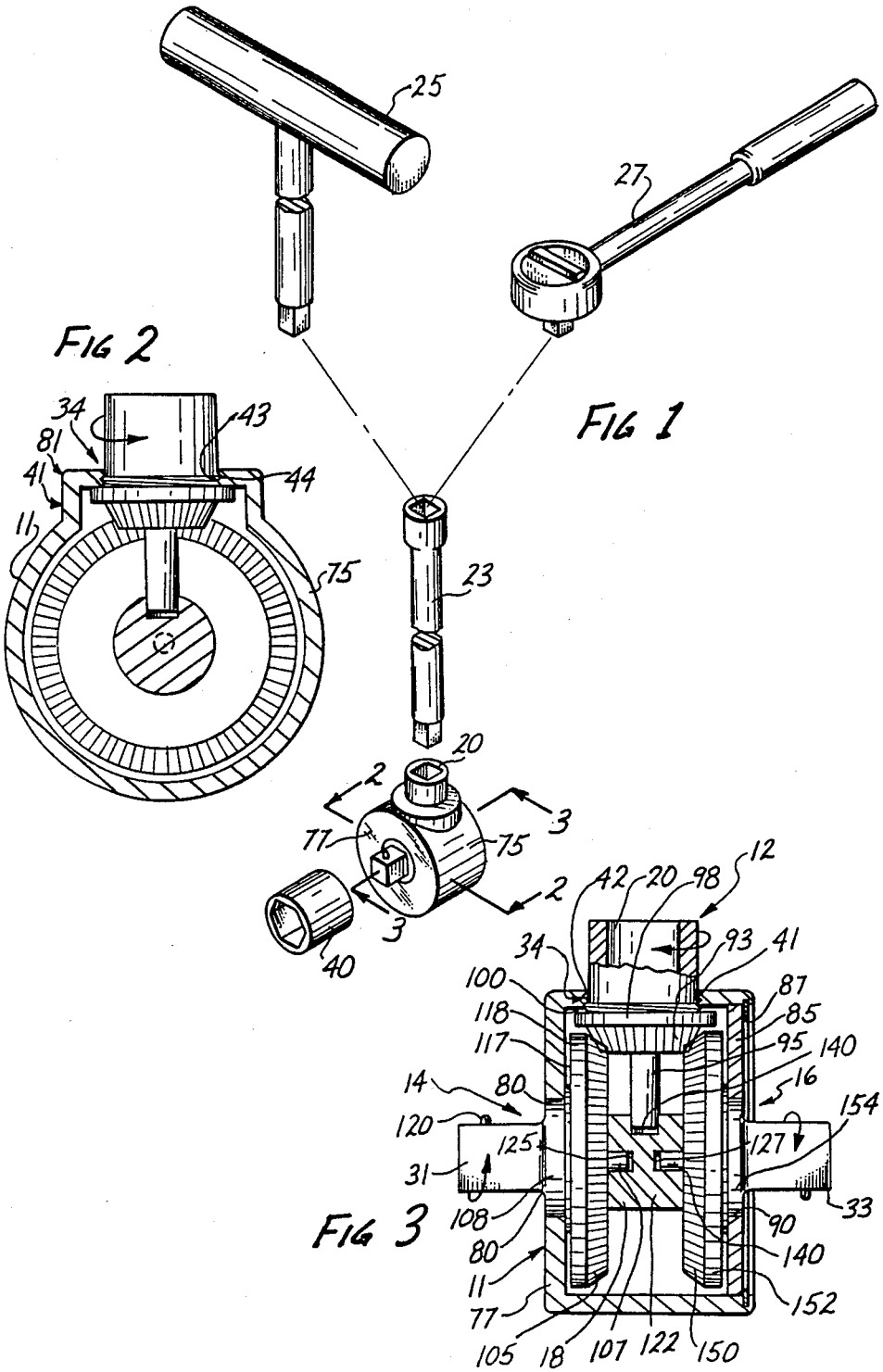
FIG. 1 a pictorial view of a tool adaptor which is constructed in accordance with the present invention, and which is adapted for use with a variety of tools.
FIG. 2 is an enlarged sectional view of the tool adaptor of FIG. 1, taken on line 2—2 thereof, shown in a locked position, for use in freeing locked nuts and bolts.
FIG. 3 is an enlarged sectional view of the tool adaptor of FIG. 1, taken on line 3—3 thereof, shown in a rotatably free position, for use in tightening or loosening nuts or bolts.

Referring now to the drawings, and more particularly to FIGS. 1 and 3 thereof, there is shown a tool adaptor 10 which is constructed in accordance with the present invention. The adaptor 10 is designed to be positioned in restricted or confined places for loosening, tightening or freeing nuts, bolts and like devices (not shown).

The adaptor 10 generally comprises a housing 11 and a top gear 12, which is secured rotatably to the housing 11 for driving a pair of substantially similar spaced-apart side gears 14 and 16. The top gear 12 includes a drive axle 20 that extends a relatively short distance beyond the housing 11, for connection to an extension 23, a T-handle 25 or a ratchet 27.

Each one of the side gears 14 and 16 is complementarily sized to mesh with the top gear 12. The side gears 14 and 16 are secured rotatably to the housing 11, and include two side axles 31 and 33 respectively, for connection to the nut or bolt to be tightened, loosened, or freed. The side gears 14 and 16 are generally similar in design and construction, and therefore only the side gear 14 will hereinafter be described in greater detail. However, it will become apparent to those skilled in the art, that different size side axles can be used for particular applications.

The adaptor 10 includes a locking mechanism 34 to cause the housing 11, the top gear 12, and the side gears 14 and 16 to become interlocked, in order to enable the use of the adaptor 10 for freeing locked nuts or bolts, particularly in confined places. A spacer 18 is disposed inside the housing 11, for causing the gears 12, 14 and 16 to be retained in position against the respective walls of the housing 11.

In operation, when it is desired to tighten or to loosen a nut or a bolt, the top gear 12 is rotated in a predetermined direction, such as in the clockwise direction so as to cause the drive axle 20 to be moved rotatably, freely, without being locked to the housing 11 by the locking mechanism 34. The clockwise rotation of the top gear disc 118 of the side gear 14 respectively. The collar 152 is positioned perpendicularly relative to the collar 98 of the top gear 12, and parallel to the collar 108 of the side gear 14.

The spacer 18 generally includes a cylindrical block 122, which is designed and dimensioned to fit inside the housing 11. The block 122 includes two oppositely disposed axial bores 125 and 127, that are aligned with one another, and that are designed to receive the short stub shaft 107 of the side gear 14 and the short stub shaft 140 of the side gear 16. A radial bore 140 extends generally perpendicularly to the axial bores 125 and 127, in order to receive a portion of the long stud shaft 95 of the top gear 12. Thus, the spacer retains the gears 12, 14 and 16 rotatably securely, and frictionally in position.

While the gears 12, 14 and 16 are described as including bevel pinion gears, it should be understood, that other types of gears, such as flat gears can be employed.

While a particular embodiment of the present invention has been disclosed, it is to be understood that various different modifications are possible and are contemplated within the true spirit and scope of the appended claims. There is no intention, therefore, of limitations to the exact abstract or disclosure herein presented.

What is claimed is:

1. A tool adapter for loosening, tightening or freeing a locked nut or bolt, comprising:

a housing;

driving gear means secured rotatably to said housing therewithin;

side gear means secured concurrently rotatably to said housing and to said driving gear means;

a drive shaft rotatably and axially movably mounted within an opening in said housing;

said driving gear means fixed to said drive shaft within said housing;

means defining a space between said driving gear means and said housing;

means for fixing releasably said shaft in a locked position with said driving gear disposed within said space; and spacing means for retaining said driving gear means and said gear means in position, said spacing means being disposed inside said housing.

2. A tool adapter as defined in claim 1, wherein said top gear means includes a drive axle that extends a relatively short distance beyond said housing, for connection to an extension tool or the like.

3. A toll adapter as defined in claim 2, wherein said side gear means includes a pair of substantially similar spaced-apart side gears.

4. A tool adapter as defined in claim 3, wherein each one of said side gears is complementary sized to mesh with said top gear means.

5. A tool adapter for loosening, tightening or freeing a locked nut or bolt comprising:

a housing;

a top gear means secured rotatably to said housing;

side gear means secured concurrently rotatably to said housing and to said top gear means;

means for locking said top gear means to said housing, for causing said top gear means and said side gear means to become interlocked and stationary;

spacing means for retaining said top gear means and said side gear means in position, said spacing means being disposed inside said housing;

said top gear means including a drive axle that extends a relatively short distance beyond said housing for connection to an extension tool or the like;

said side gear means including a pair of substantially similarly spaced-apart side gears, wherein each of said side gears is complementary sized to mesh with said top gear means; and wherein each one of said side gear includes a side axle for connection to the nut to be tightened.

6. A tool adapter as defined in claim 5, wherein said housing includes a tubular member, and a pair of side plates for closing partially the opposite ends of said member.

7. A tool adapter as defined in claim 6, wherein each one of said side gears includes a relatively short cylindrical stud shaft, that extends inwardly from said side gear, for engaging rotatably said spacing means.

8. A tool adapter as defined in claim 7, wherein each one of said side plates includes a substantially central opening, for receiving a corresponding one of said side axles.

9. A tool adapter as defined in claim 8, wherein said top gear means includes a bevel gear that tapers conically inwardly towards its central axis.

10. A tool adapter as defined in claim 9, wherein said top gear means includes a relatively long cylindrical stud shaft, that extends inwardly from said bevel gear, for engaging rotatably said spacing means.

11. A tool adapter as defined in claim 10, wherein said locking means includes at least one thread, disposed on the axle, for engaging at least one complementary sized threaded hole disposed on said housing and extending axially about the outer periphery of said drive axle.

12. A tool adapter as defined in claim 11, wherein said spacing means includes a cylindrical block, and wherein said block includes two oppositely disposed axle bores that are aligned with one another, and that are designed to receive said short stud shafts of said side gears.

13. A tool adapter as defined in claim 12, wherein said spacing means further includes a radial bore that extends generally perpendicularly to said axial bores, to receive a portion of said long stud shaft of said top gear means.

14. A tool adapter for loosening, tightening or freeing a locked nut or bolt, comprising:

a housing;

driving gear means secured rotatably to said housing therewithin;

side gear means secured concurrently rotatably to said housing and to said driving gear means;

means for locking said driving gear means to said housing, for causing said driving gear means to said side gear means to become interlocked and stationary, said means including at least one thread disposed axially about the outer periphery of said means, for engaging at least one complementary sized threaded hole disposed in said housing; and spacing means for retaining said gear means in position, said spacing means being disposed inside said housing.

* * * * *

UNITED STATES PATENT AND TRADEMARK OFFICE

CERTIFICATE OF CORRECTION

PATENT NO. : 4,813,308

DATED : March 21, 1989

INVENTOR(S) : David Petrus

It is certified that error appears in the above-identified patent and that said Letters Patent is hereby corrected as shown below:

| | |
|---|---|
| Column 5, line 44 | before "gear", please insert -- side --. |
| Column 5, line 50 | After "A", please delete "toll", and substitute therefor -- tool --. |

Signed and Sealed this

Twentieth Day of February, 1990

*Attest:*

JEFFREY M. SAMUELS

*Attesting Officer*

*Acting Commissioner of Patents and Trademarks*